US009334661B2

(12) United States Patent
Lavallee, II et al.

(10) Patent No.: US 9,334,661 B2
(45) Date of Patent: May 10, 2016

(54) INSULATION BLOWING MACHINE

(71) Applicant: INSULATION TECHNOLOGY CORPORATION, Frederick, CO (US)

(72) Inventors: Raymond Lavallee, II, Littleton, CO (US); Don Powell, Arvada, CO (US); Shawn Hurla, Platteville, CO (US)

( * ) Notice: Subject to any disclaimer, the term of this patent is extended or adjusted under 35 U.S.C. 154(b) by 0 days.

(21) Appl. No.: 14/485,902

(22) Filed: Sep. 15, 2014

(65) Prior Publication Data

US 2015/0078839 A1 Mar. 19, 2015

Related U.S. Application Data

(60) Provisional application No. 61/879,571, filed on Sep. 18, 2013.

(51) Int. Cl.
*B65G 53/40* (2006.01)
*E04F 21/08* (2006.01)

(52) U.S. Cl.
CPC ..... *E04F 21/085* (2013.01)

(58) Field of Classification Search
USPC ..... 406/52, 65, 122, 135, 140, 144
See application file for complete search history.

(56) References Cited

U.S. PATENT DOCUMENTS 3,861,599 A * 1/1975 Waggoner ..... B05B 7/1409 239/654
3,995,775 A * 12/1976 Birkmeier ..... E04F 21/085 406/135
4,111,493 A * 9/1978 Sperber ..... D01G 23/00 198/532
4,129,338 A * 12/1978 Mudgett ..... E04F 21/085 222/236
4,337,902 A * 7/1982 Markham ..... B02C 13/288 241/188.1
4,560,307 A 12/1985 Deitsfeld
4,808,042 A * 2/1989 Muehlberger ..... B01J 8/002 406/135
5,114,281 A * 5/1992 Hartnett ..... E04F 21/085 222/617
5,511,730 A 4/1996 Miller et al.
5,647,696 A * 7/1997 Sperber ..... E04F 21/12 198/575
5,669,740 A * 9/1997 Townsend ..... A01G 13/0287 406/135
5,725,332 A 3/1998 Harper et al.
5,788,163 A * 8/1998 Woten ..... B05B 7/1409 239/656
5,931,610 A * 8/1999 Rixom ..... B01F 7/30 222/58
6,796,748 B1 * 9/2004 Sperber ..... E04F 21/085 222/636
7,520,935 B2 4/2009 Fellinger
2007/0141248 A1 6/2007 Dolin et al.

(Continued)

OTHER PUBLICATIONS

Krendl Fiberglass & Cellulose Machine #500, Product Brochure: http://www.regalind.com/pdf/Krendl/Krendl%20-%20500.pdf.

(Continued)

*Primary Examiner* — Joseph Dillon, Jr.
(74) *Attorney, Agent, or Firm* — Dan Shifrin

(57) ABSTRACT

An insulation blowing machine is provided, comprising an upper section, comprising a hopper, an agitator, and an agitator motor coupled to drive the agitator; a base, comprising a blower, an airlock, and an airlock motor coupled to drive airlock paddles within the airlock; and a pivoting mechanism connecting the upper section with the base, whereby the upper section is tiltable on the pivoting mechanism away from the base to an open position without disassembly or disengagement of components in the upper section from components in the base to expose the airlock paddles within the airlock; whereby, in operation insulation fed into the hopper passes through an opening in the bottom of the hopper and into the airlock to be discharged through an outlet.

3 Claims, 15 Drawing Sheets

(56) References Cited

U.S. PATENT DOCUMENTS

| | | | | |
|---|---|---|---|---|
| 2007/0246584 | A1* | 10/2007 | Bowman | E04F 21/085 241/60 |
| 2009/0129872 | A1 | 5/2009 | Dolin et al. | |

OTHER PUBLICATIONS

Cool Machines Blowing Machines: http://www.coolmachines.com/blowing-machines/.

* cited by examiner

INSULATION BLOWING MACHINE

RELATED APPLICATION DATA

The present Application is related to commonly-assigned U.S. Pat. No. 4,560,307, entitled INSULATION BLOWER and issued on Dec. 24, 1985, to Deitesfeld, which patent is incorporated herein by reference in its entirety. The present Application is also related to and claims the benefit of commonly-assigned U.S. Provisional Appl. Ser. No. 61/879,571, filed Sep. 18, 2013 and entitled INSULATION BLOWING MACHINE, which application is incorporated herein by reference in its entirety

TECHNICAL FIELD

The present invention relates generally to insulation blowing machines and, in particular, to an insulation blowing machine with easy access to the interior components.

BACKGROUND ART

Commercial-grade machines used to blow insulation into attics, walls, and other spaces in houses and other buildings are typically large, such as over four feet high, and complicated with numerous hard-to-reach components. Bales of insulation, such as cellulose or fiberglass, are loaded into a hopper at the top of the machine, agitated to be broken up, injected into an airstream, and blown out of the machine into a hose to be sprayed where desired. Before a bale is loaded into the hopper, the wrapper may be cut open with a cutting tool. Occasionally, the machine's operator will drop the tool or other foreign object into the hopper. Because of the size of the machine, it can be very difficult for the operator to retrieve the tool or object and often the machine must be disassembled in order to do so. Similarly, repairs and routine maintenance frequently require the machine to be disassembled. Typically, disassembly, service, and reassembly must be performed by a trained technician in a shop setting, requiring that the machine be removed from the job site for a lengthy period of time.

SUMMARY OF THE INVENTION

In one embodiment, the present invention provides an insulation blowing machine, comprising an upper section, comprising a hopper, an agitator, and an agitator motor coupled to drive the agitator; a base, comprising a blower, an airlock, and an airlock motor coupled to drive airlock paddles within the airlock; and a pivoting mechanism connecting the upper section with the base, whereby the upper section is tiltable on the pivoting mechanism away from the base to an open position without disassembly or disengagement of components in the upper section from components in the base to expose the airlock paddles within the airlock; whereby, in operation insulation fed into the hopper passes through an opening in the bottom of the hopper and into the airlock to be discharged through an outlet.

In another embodiment, the present invention provides an insulation blowing machine, comprising an upper section, comprising a hopper and an agitator; a base, comprising a blower, an airlock, and airlock paddles within the airlock; a common motor coupled to drive the agitator and the airlock paddles; and a pivoting mechanism connecting the upper section with the base, whereby the upper section is tiltable on the pivoting mechanism away from the base to an open position without disassembly or disengagement of components in the upper section from components in the base to expose the airlock paddles within the airlock; whereby, in operation insulation fed into the hopper passes through an opening in the bottom of the hopper and into the airlock to be discharged through an outlet.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1A:
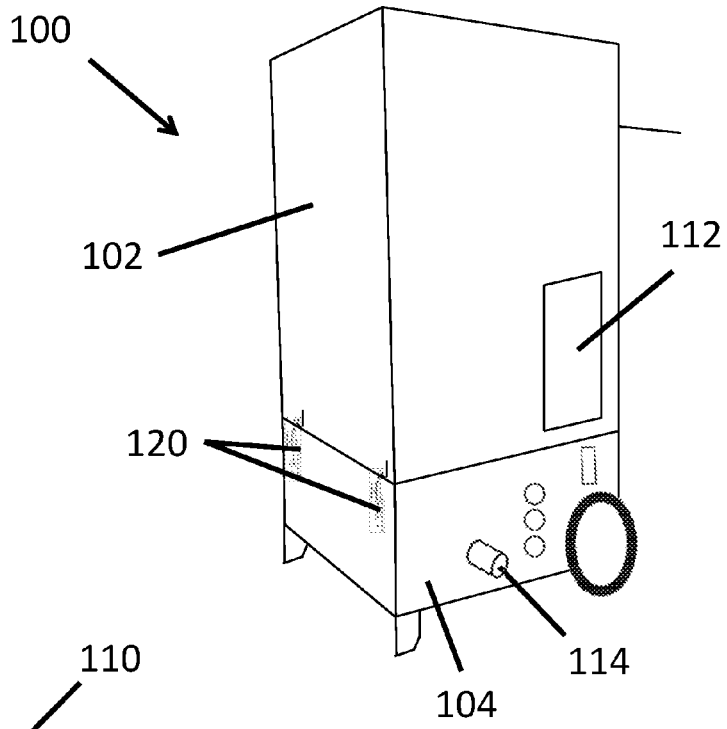
FIGS. 1A and 1B (collectively "FIG. 1") illustrate back and front perspective views, respectively of an embodiment of an insulation blowing machine of the present invention.
Figure 1B:
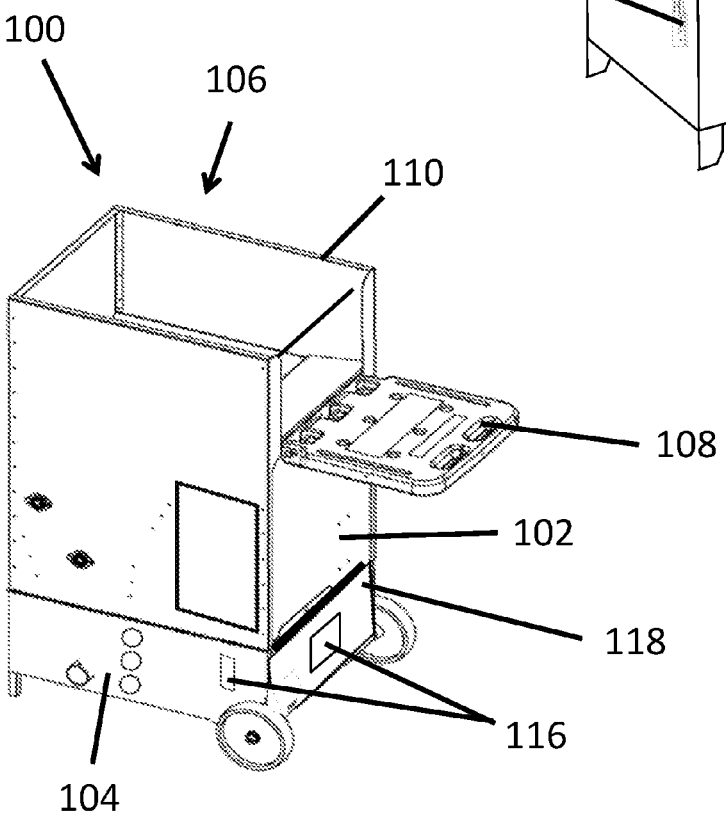
Figure 2:
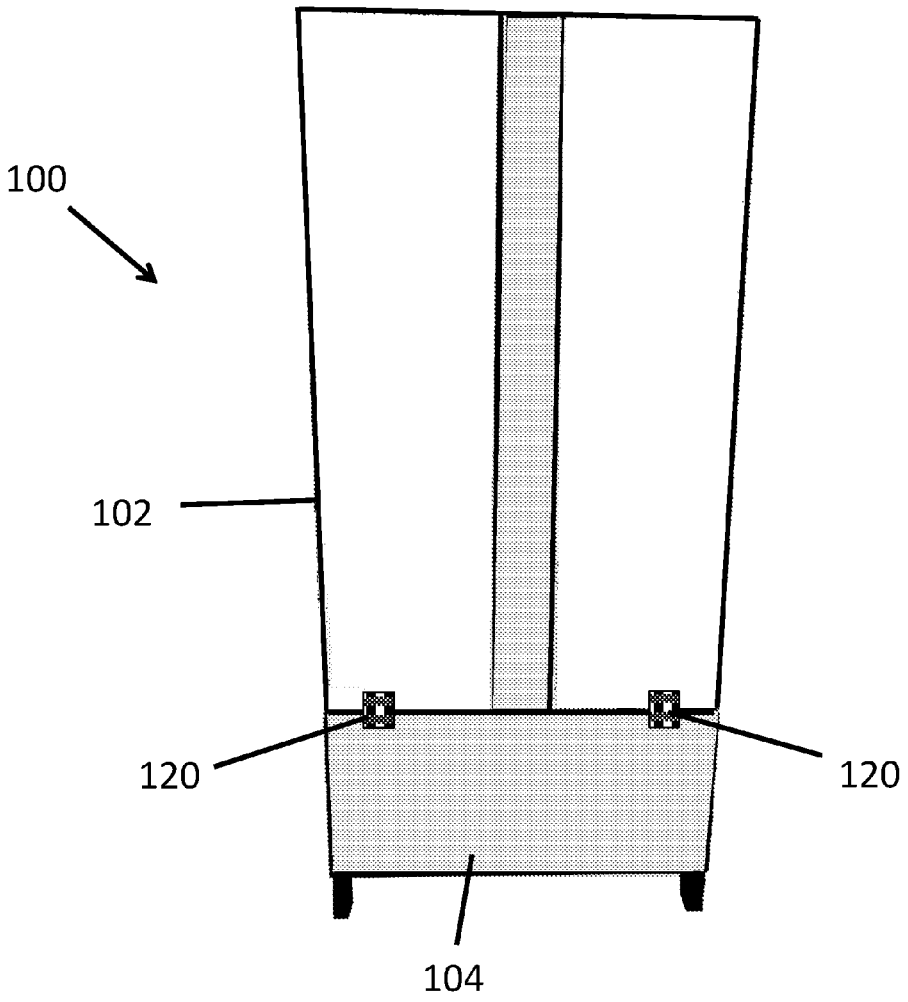
FIG. 2 illustrates a back view of the insulation blowing machine of FIG. 1.

FIGS. 1A and 1B illustrate back and front perspective views, respectively of an embodiment of insulation blowing machine 100 of the present invention. The machine 100 includes an upper section 102 and a base 104 on which the upper section 102 is secured. The upper section 102 may include, among other components, a hopper 106, a loading platform 108 at the open top of the hopper 106, a breaker bar 110 adjacent the loading platform 108, and an electrical panel 112 with machine controls. The base 104 may include, among other components, an insulation outlet 114 and air inlet filters 116. As will be described below, the upper section 102 and the base 104 may be connected with a pivoting mechanism, such as a hinge 118, on one side of the machine 100 to allow the upper section 102 to be tilted back from the base 104. The upper section 102 and the base 104 may be secured with any appropriate mechanism, such as latches 120. Two latches 120 are shown in FIGS. 1A and 2 on the side of the machine 100 opposite the hinge 118 for purposes of illustration and not limitation. It will be appreciated that any number and any type of mechanism may be used in any location, such as the sides, to secure the upper section 102 to, and release it from, the base 104. Further, the hinge 118 is illustrated as a single, piano-type hinge. However, other types of hinges and pivoting mechanisms may be used without departing from the scope of the invention.

Figure 3:
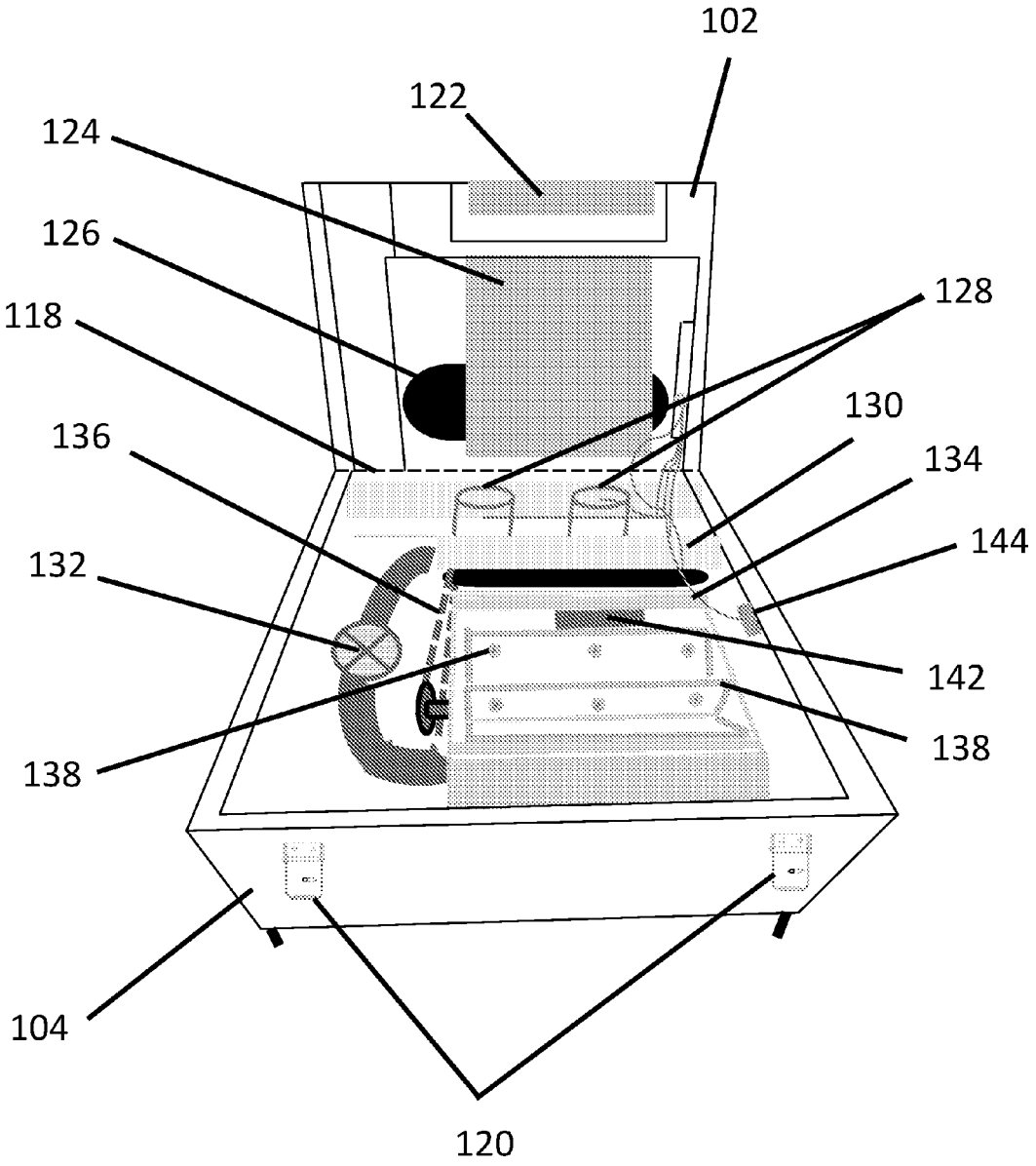
FIG. 3 illustrates an interior view of components within the insulation blowing machine of FIG. 1.

FIG. 3 illustrates interior components of the machine 100 when the upper section 102 has been tilted back from the base 104. In addition to the components in mentioned above, the upper section 102 may also include an exit 122 from the hopper 106, a gate 124 at the exit 122, and an agitator motor 126 adjacent to the gate 124. In addition to the components in mentioned above, the base 104 may also include one or more blower motors 128, a manifold 130 for the blower motors 128, a check valve 132, an airlock housing 134, and an airlock motor 136. Within the airlock housing 134 are airlock paddles 138 with seals 140 along the outer edges of the paddles 138.

Summarizing the operation of the insulation blowing machine 100, after the machine 100 has been set up at a location with the loading platform 108 in its horizontal/down position, a hose is attached to the outlet 114, the gate 124 is opened a desired amount, and the machine 100 is plugged into electrical power and turned on. Although machine 100 is typically operated with the gate 124 in its fully opened position, the slide gate 124 may be partially closed to increase the agitation and conditioning of the insulation or to reduce the amount of insulation in the airflow. A bale of insulation may then be placed on the loading platform 108, pushed against the breaker bar 110 (for certain insulation materials), and into the hopper 106. The insulation falls to the bottom of the hopper 106 and is broken up and conditioned by the agitators (not shown), which are powered by the agitator motor 126. The agitators move the insulation out the exit 122, through the slide gate 124, and into the airlock 134. The airlock 134 allows the insulation to enter the airstream, generated by the blowers 128, without coming into contact with the blowers 128 themselves. After entering the airstream, the insulation is discharged through the outlet 114 and into the hose to be sprayed where desired.

Foreign objects, such as cutting tools, will occasionally accidentally fall into the hopper 106. As was noted above, retrieving such objects from a conventional insulation blowing machine is difficult and time consuming. The object may be too far down in the hopper 106 for an operator to reach. Even if the object is theoretically within reach, it may be buried in the insulation and difficult and time consuming to locate. Finally, again even if the object is theoretically within reach, there is a significant risk that the operator may cut his or her hand or arm on the foreign object (if it is a cutting tool), the agitator, or other component. Consequently, the operator may not want to even attempt to retrieve the object by reaching into the hopper 106.

Figure 4:
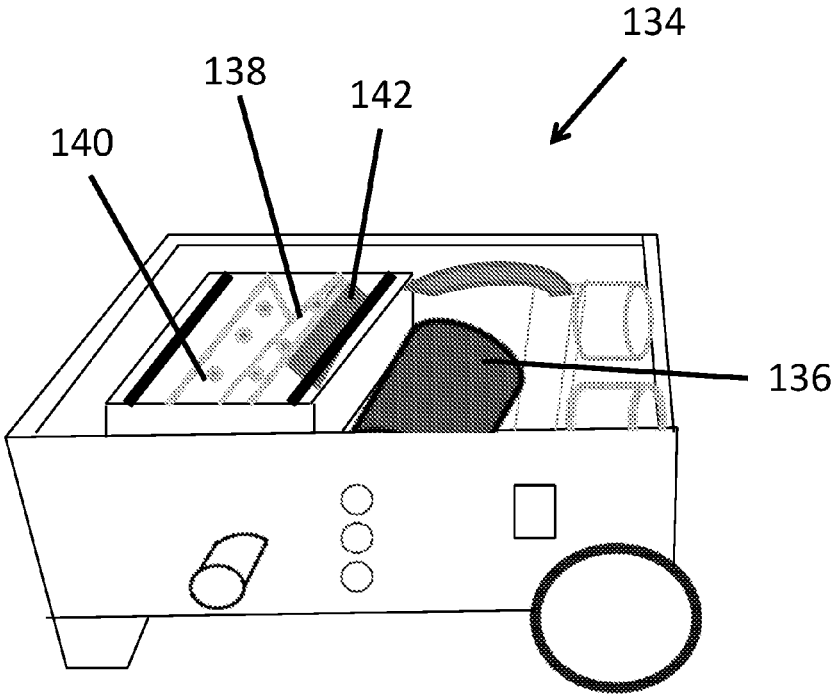
FIG. 4 illustrates a view of a piece of wood jammed within the airlock assembly of the insulation blowing machine of FIG. 1

The foreign object may have gone through the hopper 106 and lodged in the airlock 134. FIG. 4 illustrates a piece of wood 142 that has been wedged in the airlock 134. A conventional insulation blowing machine would have to be disassembled in order to expose the airlock and remove the object as it cannot be retrieved by reaching into the hopper 106. However, the machine operator may not have the skill or knowledge required to disassemble the machine. Consequently, the machine would have to be taken back to the shop for disassembly and service by an experienced technician, a process that may take 45 minutes or longer. The machine then must be re-assembled and returned to the original location, consuming even more time. Therefore, being anxious to complete a job, the operator may continue to run the machine, risking damage to the hopper 106, the airlock housing 134, the airlock paddles 138, the airlock seals 140, the airlock motor 136, and other components. Similarly, scheduled routine and preventative maintenance, such as the replacement of worn airlock seals 140 due to normal use, typically requires that the machine be taken back to the shop for disassembly and service by an experienced technician.

Figure 5A:
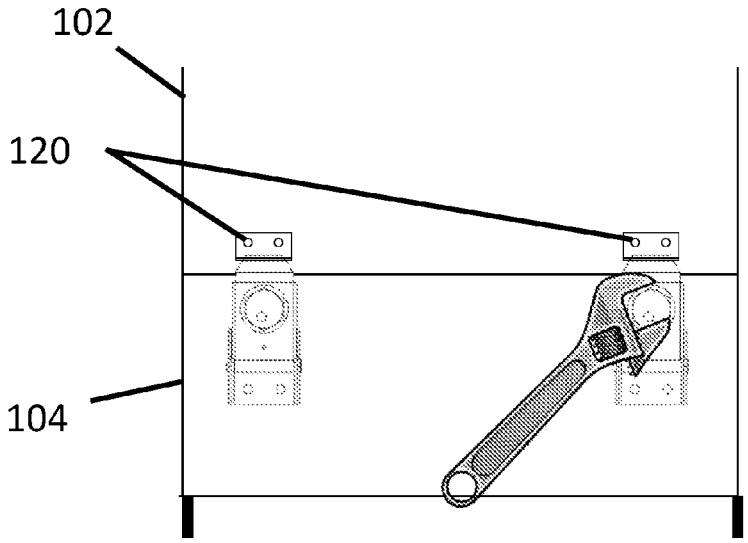
FIGS. 5A and 5B illustrate views of the upper section being unlatched from the base of the insulation blowing machine of FIG. 1.
Figure 5B:
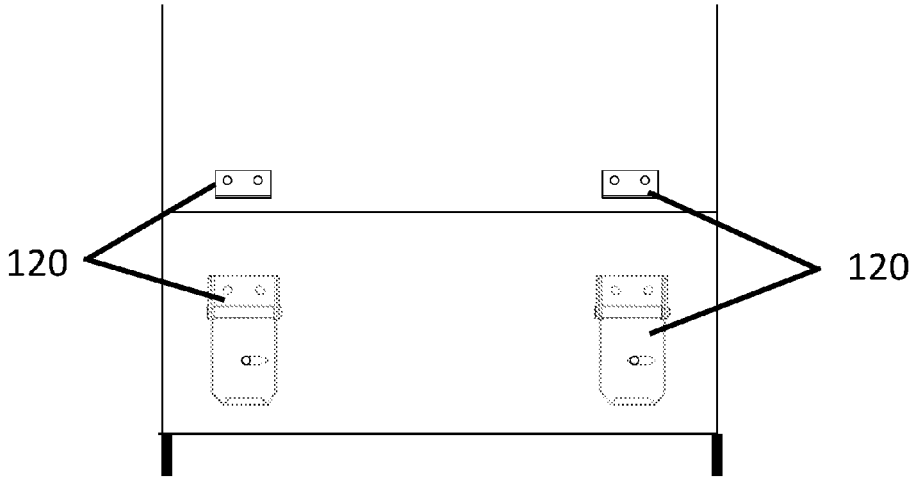
Figure 6A:
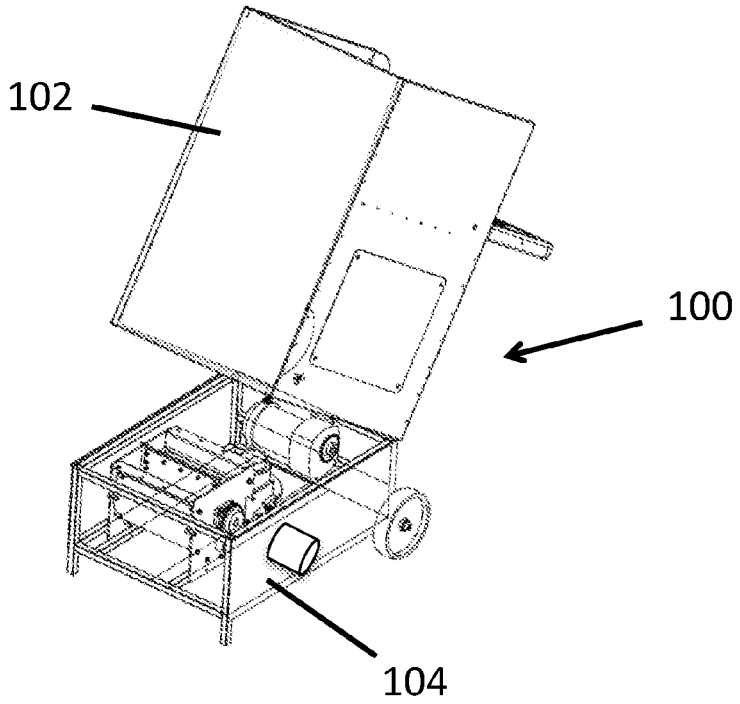
FIGS. 6A and 6B illustrate perspective views of the upper section of the insulation blowing machine of FIG. 1 being tilted back from the base.
Figure 6B:
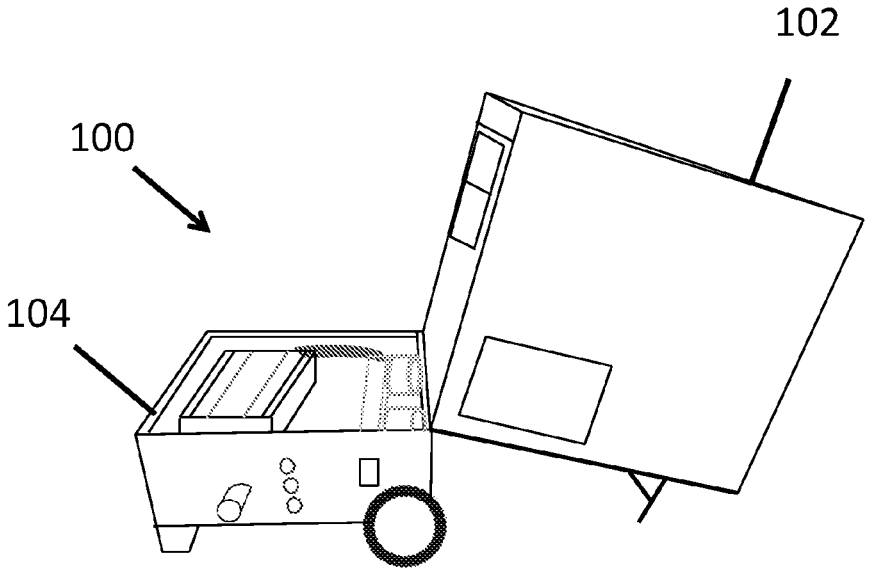

In contrast, the insulation blowing machine 100 of the present invention provides the ability to tilt the upper section 102 back from the base 104, offering quick and easy access to the interior components without the need to disassemble any components or disengage any belts, chains, agitators, augers, or the like. Referring to FIGS. 5A and 5B, the latches 120 are released. A tool, such as a wrench, may be required to release the latches 120, as illustrated in the FIGS. Alternatively, the latches 120 may be a tool-less design for even quicker release. After the latches 120 have been released, the upper section 102 may be tilted back on the hinge 118 (FIG. 6A) and rested on the ground (FIG. 6B). The various interior components can be quickly exposed for easy service, such as the removal of the foreign object 142 from the airlock 134, by the operator in the field without disassembling the machine 100. Additionally, the contents of the hopper 106 become more accessible, making it easier to reach and remove a foreign object within the hopper 106 or, if necessary, to empty the insulation from the hopper to look for and remove foreign objects from the insulation.

For safety, the machine 100 may also include an interlock, such as a magnetic disconnect sensor 144 (FIG. 3), to automatically disconnect all of the electric components from the power source when the upper section 102 is tilted back. Using an interlock prevents any of the exposed electrical components from accidentally being powered on while the upper section 102 is tilted back.

Figure 12A:
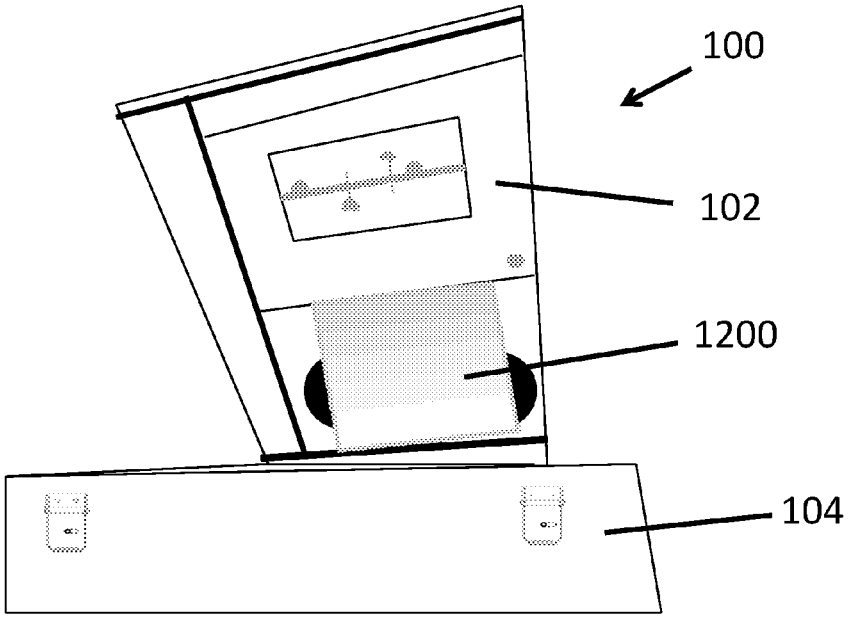
FIGS. 12A and 12B (collectively "FIG. 12") illustrate a hopper gate in the open and closed positions, respectively, at the base of the upper section of the insulation blowing machine of FIG. 1.
Figure 12B:
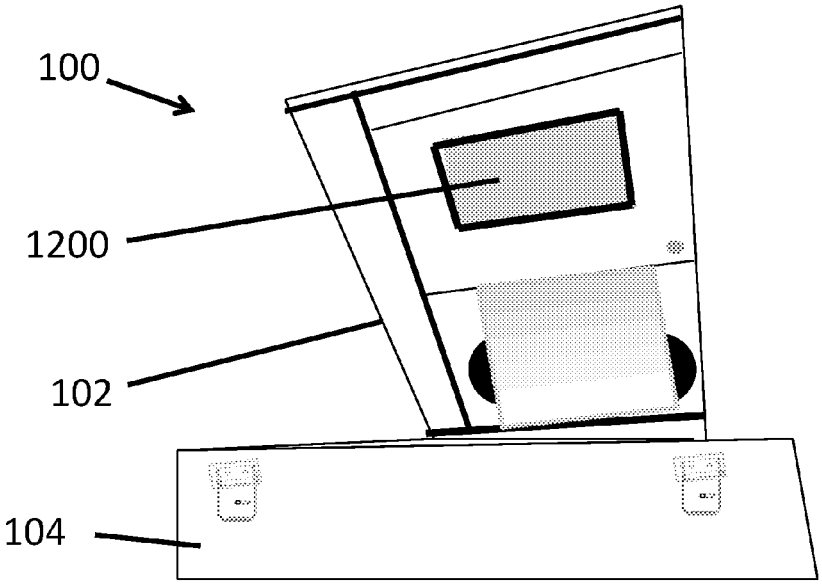

Further, in contrast to conventional insulation blowing machines in which a single motor powers the agitator and airlock through chains or belts which have to be removed when the machine is opened, the agitator and airlock in the machine 100 of the present invention are powered by separate motors 126, 136, respectively. The upper section 102 may thus be tilted back from the base 104 without removing any chains or belts that would otherwise connect the agitator and airlock to a single motor, thereby simplifying the process. In one embodiment, the machine 100 may also include a gate 1200 (FIGS. 12A, 12B) at the bottom of the upper section 102 which may be slid from an open position (FIG. 12A) into a closed position (FIG. 12B) to close the bottom of the hopper 106 and prevent insulation from falling out when the upper section 102 is tilted back.

Embodiments of the present invention also provide an insulation machine having a single motor that powers both the agitator and the airlock but in which the upper section that may be tilted back without the need to disassemble any components or disengage any belts, chains, agitators, augers, or the like. Designing an insulation blowing machine with a single motor, as described below with respect to FIGS. 7-11, provides a number of benefits not present in a two-motor machine. Using a single motor reduces the cost to manufacture the machine as typically a single larger motor is less expensive than two smaller motors. Further, because each motor requires a gearbox or similar mechanism, using a single gearbox provides additional cost savings. A single motor also reduces the electrical requirements. For example, a single, 15 amp common motor may replace a 9.5 amp agitator motor and a 7.8 amp airlock motor having a combined load of 17.3 amps. The reduction in current draw is a significant 13.3%. At least as important, however, is that the two motors would require a 20 amp circuit while a single 15 amp motor requires a more common 15 amp circuit.

A single motor may provide improved power distribution because the motor is able to distribute more power where it is needed the most. Thus, the motor is able to provide more power to the agitator when needed there and more power to the airlock when needed there. A single-motor machine also benefits from better weight balance, space savings, and greater flexibility in positioning the motor within the machine.

Figure 7A:
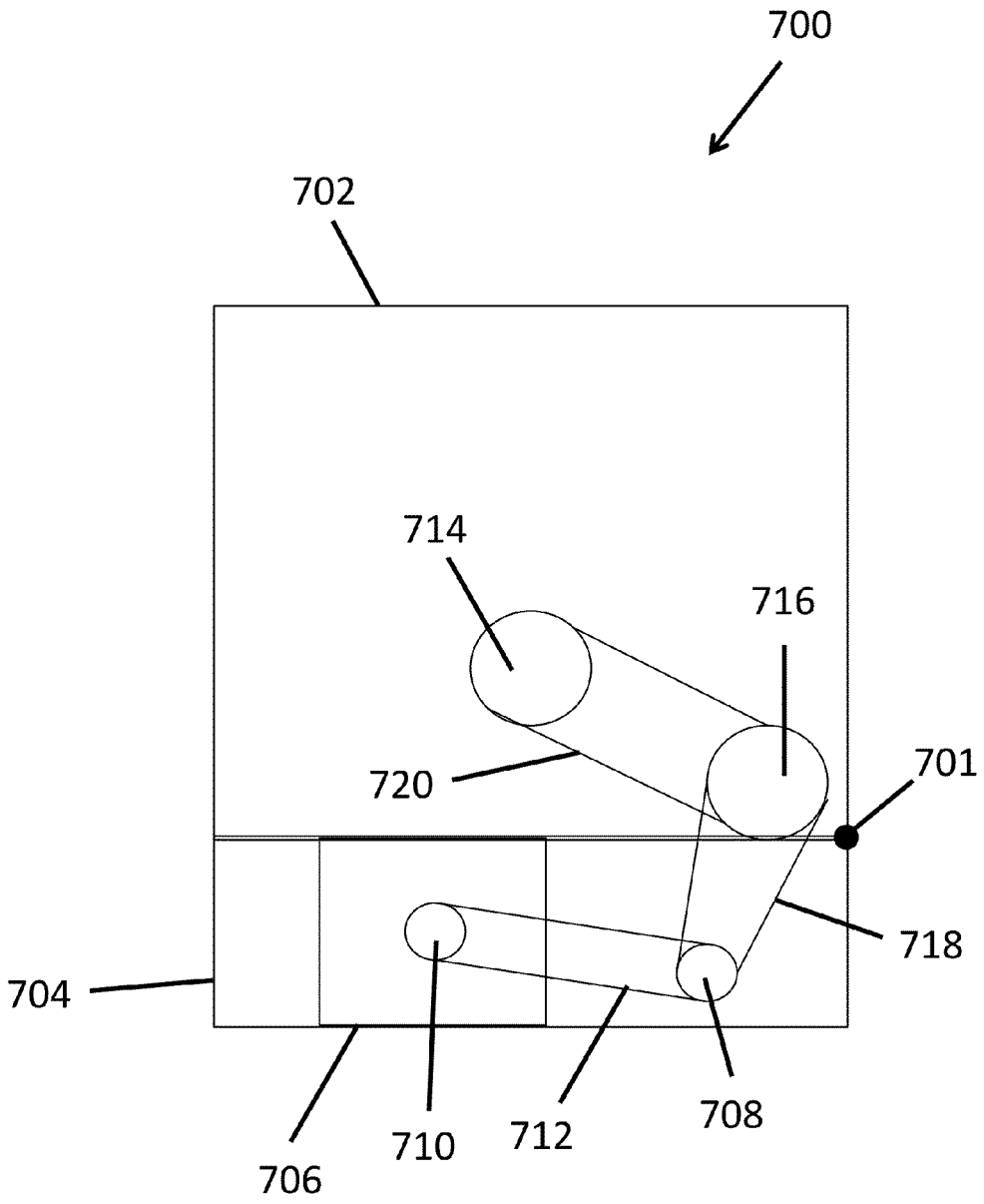
FIGS. 7A and 7B (collectively "FIG. 7") illustrate side cross-section views of a second embodiment of an insulation blowing machine of the present invention in the closed and open positions, respectively.
Figure 7B:
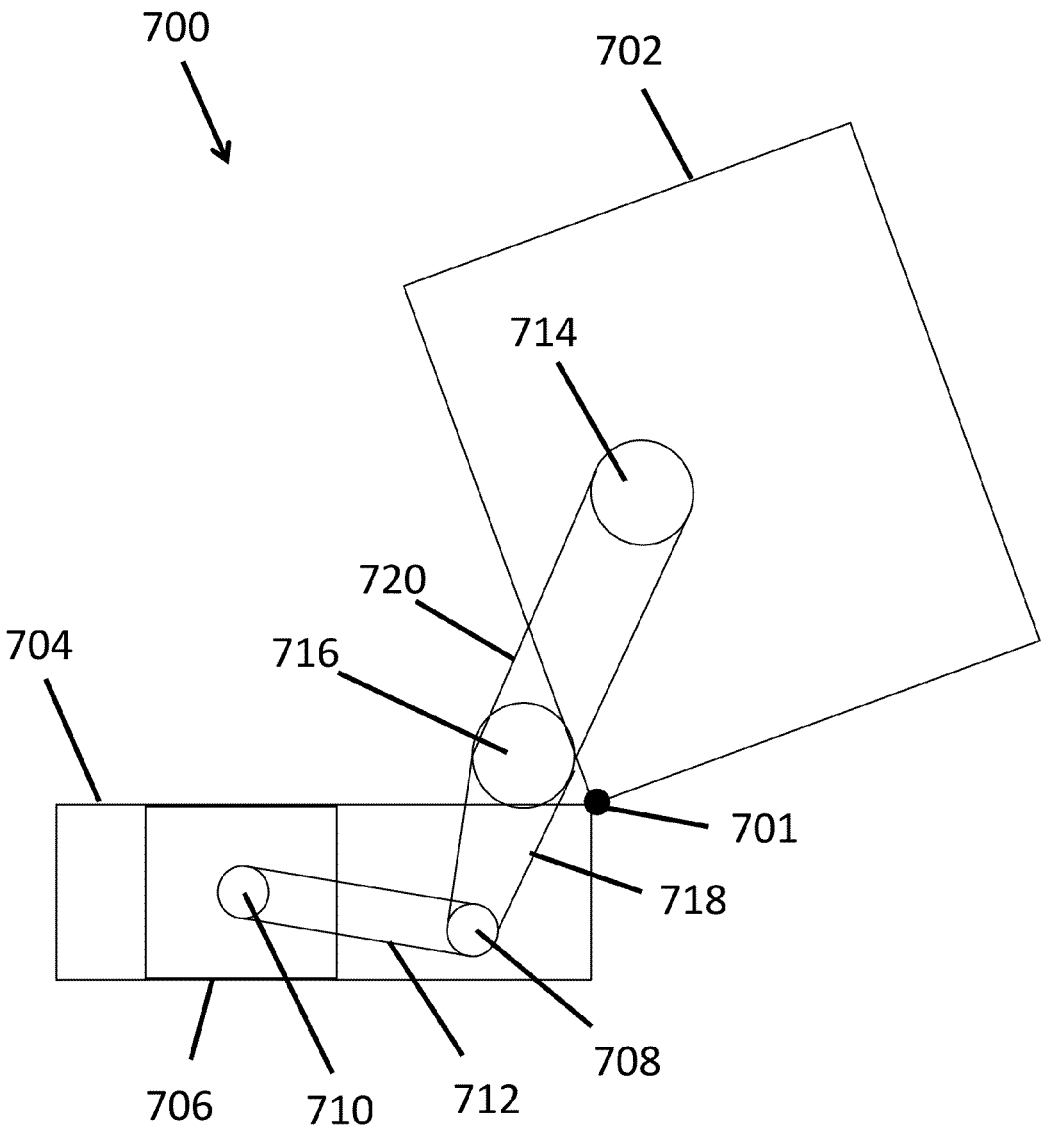

FIGS. 7A and 7B (collectively FIG. 7) schematically illustrate one such embodiment of an insulation blowing machine 700 in the closed position (FIG. 7A) and open position (FIG. 7B). The machine 700 includes an upper section with a hopper 702 and a base 704 connected by a pivoting mechanism 701 (such as a hinge or set of hinges) allowing the upper section to be tilted from a closed position back from the base 704 into an open position. The base 704 includes an airlock 706 and airlock paddle axle 710. The hopper 702 includes an agitator axle 714 coupled to an agitator. In the embodiment of FIG. 7, a common airlock/agitator motor 708 is located in the base 704 (as illustrated) or hopper 702 and is coupled to the airlock paddle axle 710 with a belt 712. The common motor 708 is also coupled to the agitator 714 through an axle 716 and belts 718 and 720. The axle 716 is preferably secured to the hopper 702 or base 704 close to the pivoting mechanism 701 to limit its movement when the hopper 702 is opened and tilted back (FIG. 7B). By restricting the movement of the axle 716, none of the connecting belts 712, 718, 720 need to be removed. As used herein, the term "belt" is generic and defined to mean belts, chains, rods, and any other means of transferring the rotational motion of the common motor to other components of the machine.

Figure 8A:
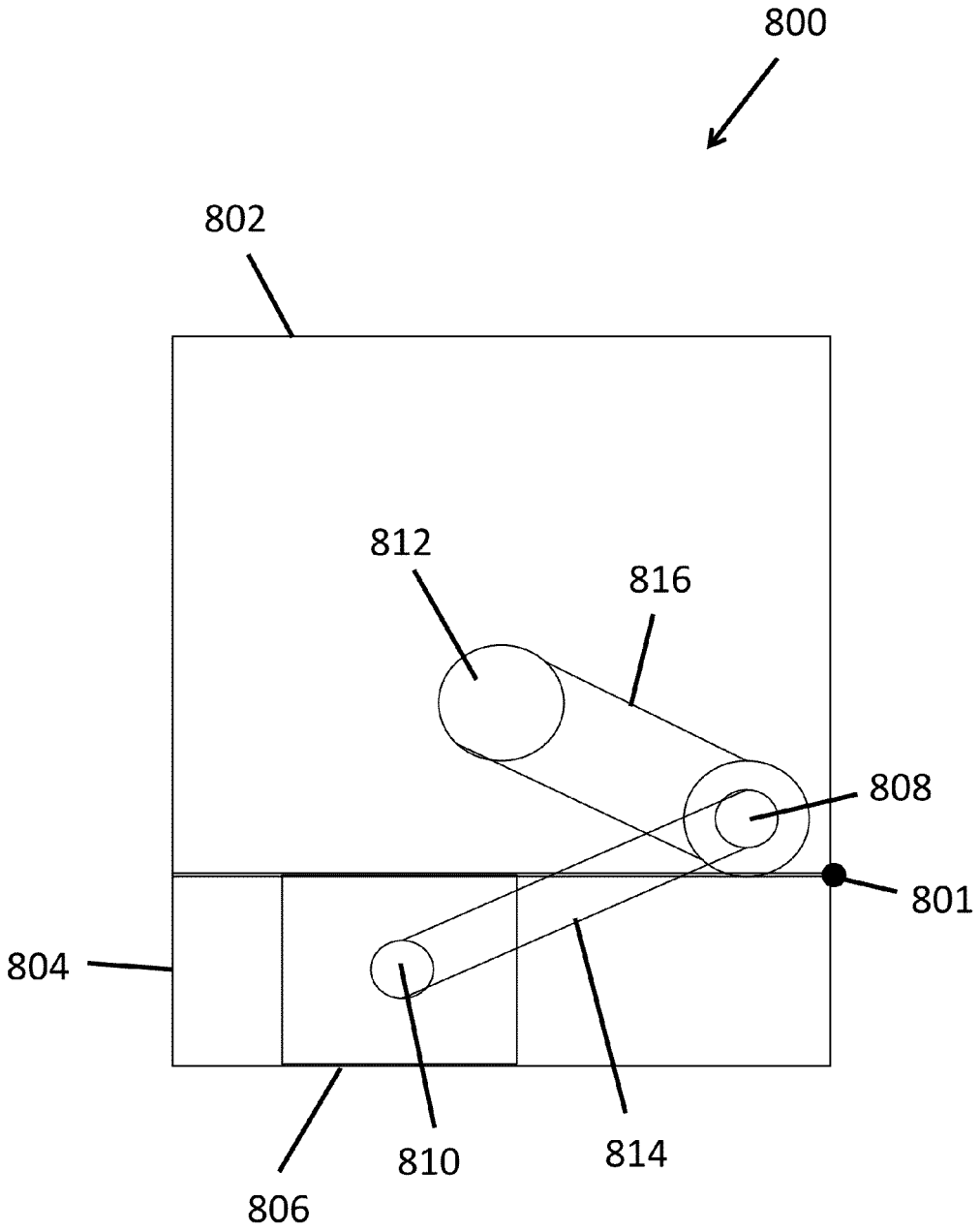
FIGS. 8A and 8B (collectively "FIG. 8") illustrate side cross-section views of a third embodiment of an insulation blowing machine of the present invention in the closed and open positions, respectively.
Figure 8B:
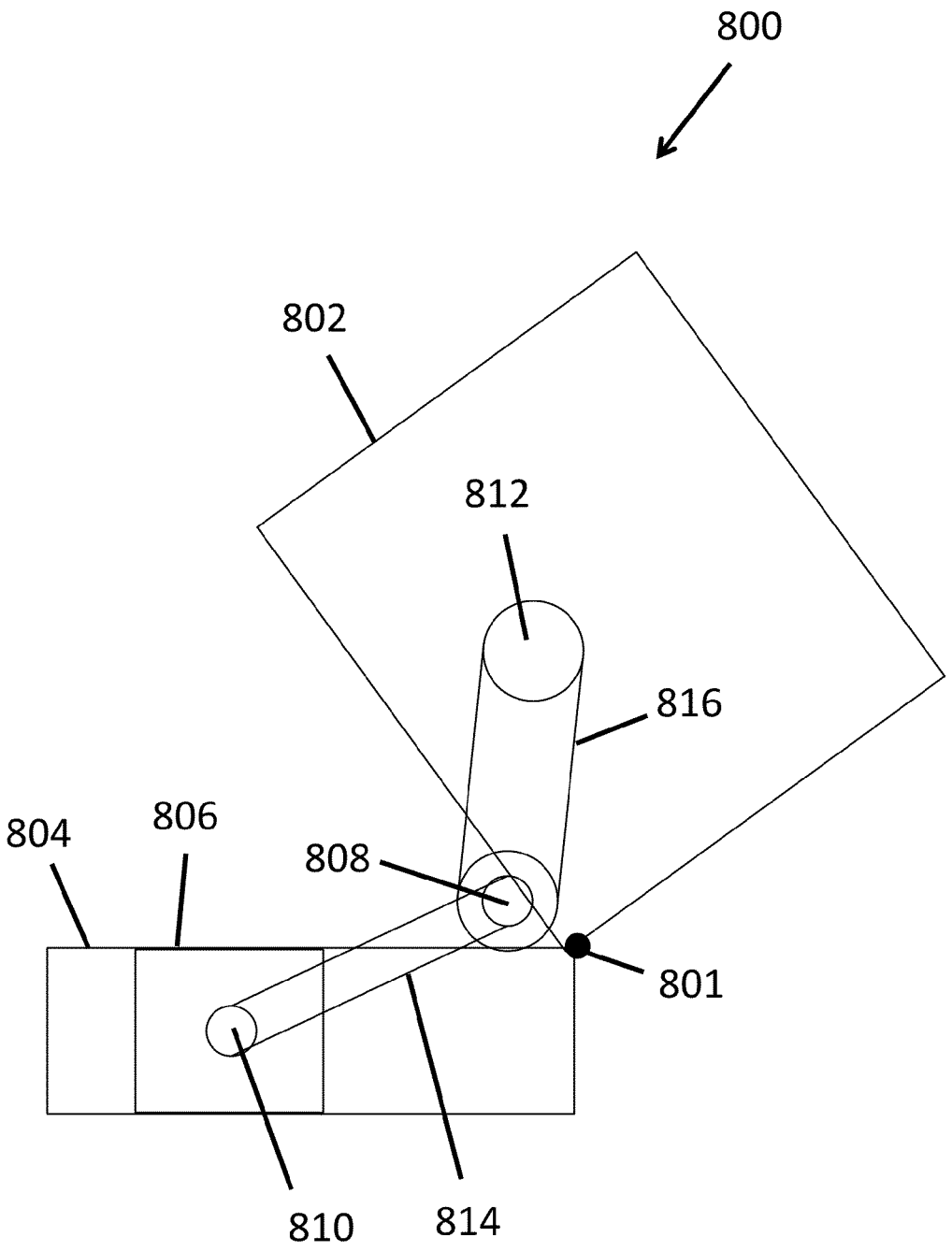

FIGS. 8A and 8B (collectively FIG. 8) schematically illustrate another embodiment of an insulation blowing machine 800 in the closed position (FIG. 8A) and open position (FIG. 8B). The machine 800 includes an upper section with a hopper 802 and a base 804 connected by a pivoting mechanism 801 (such as a hinge or set of hinges) allowing the upper section to be tilted from a closed position back from the base 804 into an open position. The base 804 includes an airlock 806 and airlock paddle axle 810. The hopper 802 includes an agitator axle 812 coupled to an agitator. In the embodiment of FIG. 8, a common airlock/agitator motor 808 is located in the hopper 802 (as illustrated) or base 804 and is coupled to the airlock paddle axle 810 with a belt 814. The common motor 808 is also coupled to the agitator 812 through a belt 816. The common motor 808 is preferably secured to the hopper 802 or base 804 close to the pivoting mechanism 801 to limit its movement when the hopper 802 is opened and tilted back (FIG. 8B). By restricting the movement of the common motor 808, none of the connecting belts 814, 816 need to be removed.

Figure 9A:
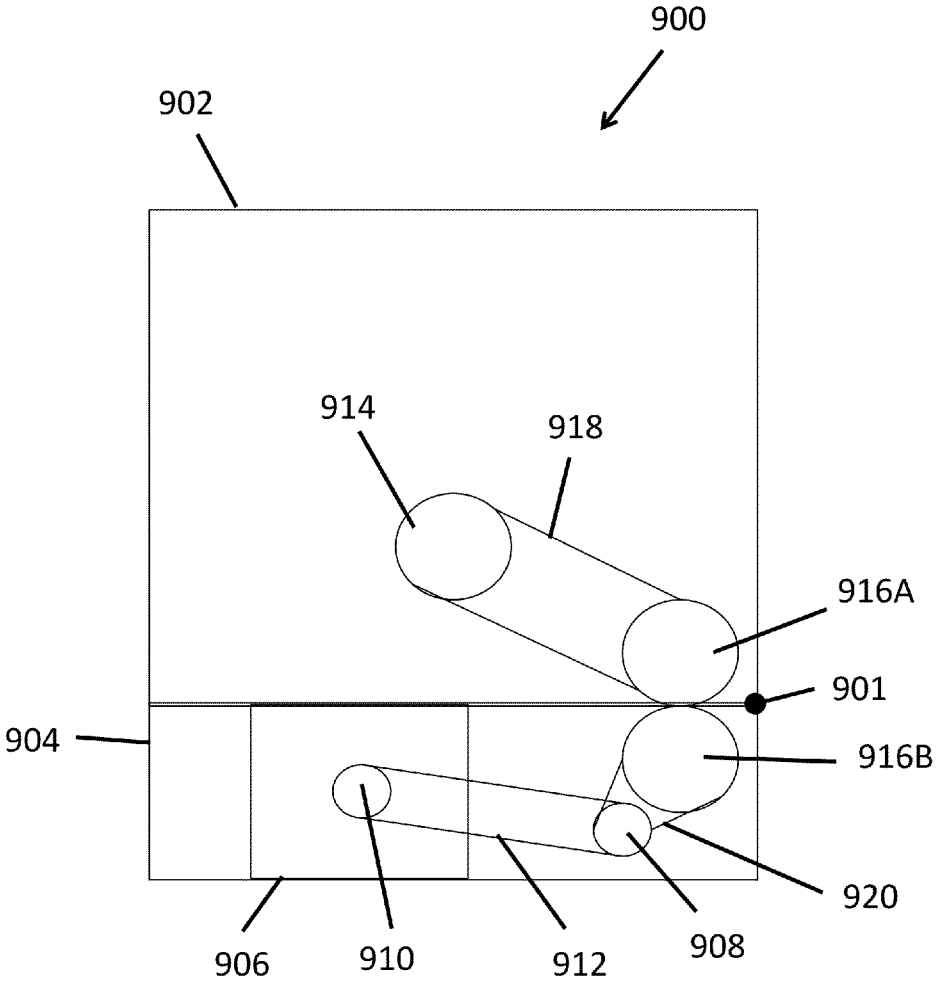
FIGS. 9A and 9B (collectively "FIG. 9") illustrate side cross-section views of a fourth embodiment of an insulation blowing machine of the present invention in the closed and open positions, respectively.
Figure 9B:
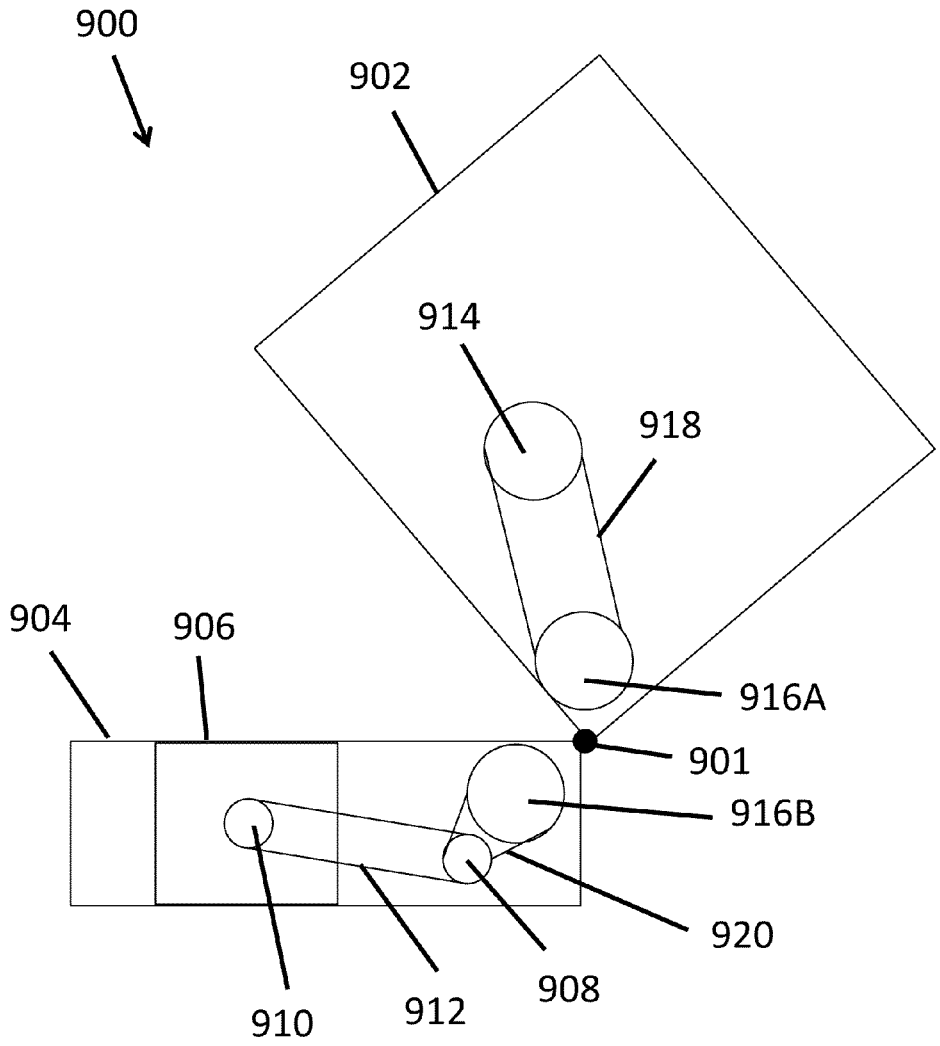

FIGS. 9A and 9B (collectively FIG. 9) schematically illustrate still another embodiment of an insulation blowing machine 900 in the closed position (FIG. 9A) and open position (FIG. 9B). The machine 900 includes an upper section with a hopper 902 and a base 904 connected by a pivoting mechanism 901 (such as a hinge or set of hinges) allowing the upper section to be tilted from a closed position back from the base 904 into an open position. The base 904 includes an airlock 906 and airlock paddle axle 910. The hopper 902 includes an agitator axle 914 coupled to an agitator. In the embodiment of FIG. 9, a common airlock/agitator motor 908 is located in the base 904 and is coupled to the airlock paddle axle 910 with a belt 912. The common motor 908 is coupled to the agitator 914 through a set of upper and lower gears 916A, 916B in the hopper 902 and base 904, respectively. The gears 916A, 916B mesh when the machine 900 is in the closed position, thereby transferring power from the common motor 908 to the agitator 914, and separate when the machine 900 is in the open position. The agitator 914 is connected to the upper gear 916A with a belt 918. The common motor 908 may be directly connected to the lower gear 916B or, instead, may be coupled through a belt 920, which may provide more flexibility with respect to the location of the common motor 908. It will be appreciated that the common motor 908 may also be located in the hopper 902 with appropriate changes in the configuration of other components. Use of the meshing gears 916A, 916B also facilitates the complete removal of the hopper 902 from the base 904 for service, repairs, or other reasons.

Figure 10A:
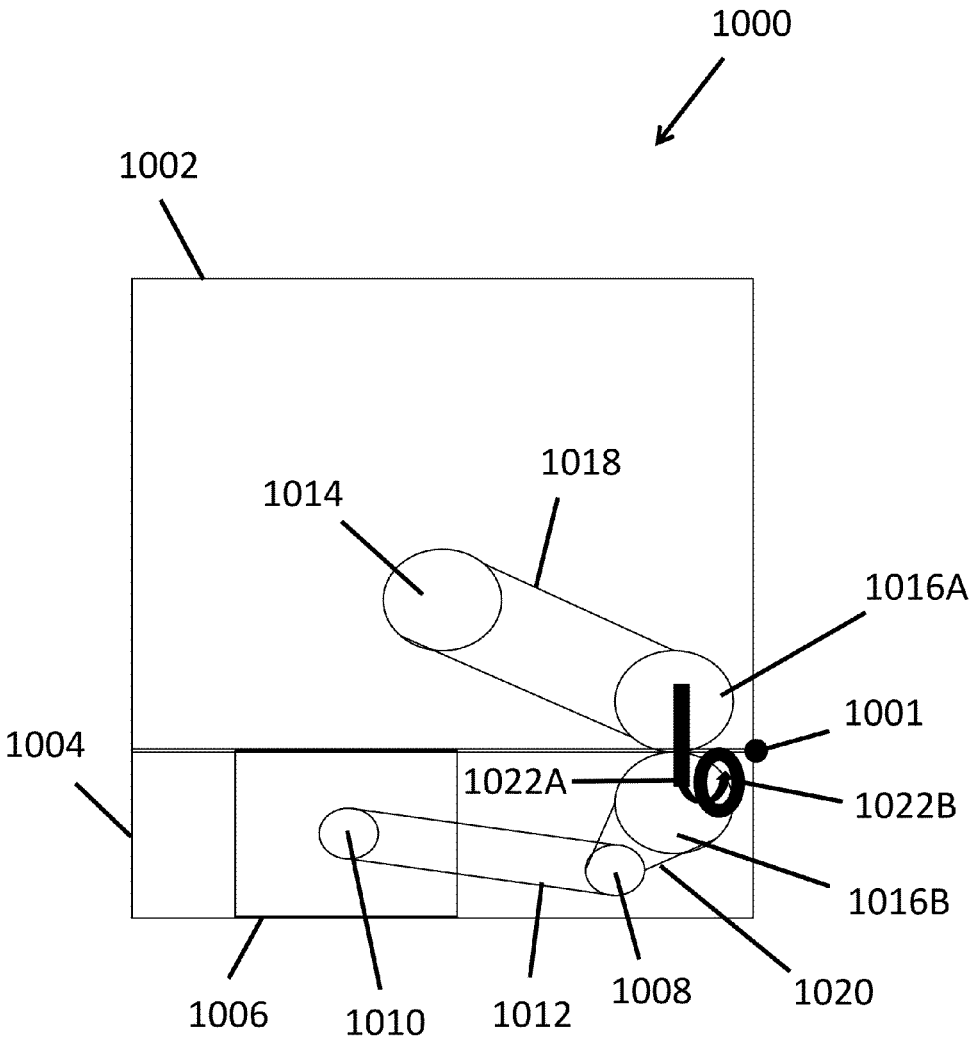
FIGS. 10A and 10B (collectively "FIG. 10") illustrate side cross-section views of a fifth embodiment of an insulation blowing machine of the present invention in the closed and open positions, respectively.
Figure 11:
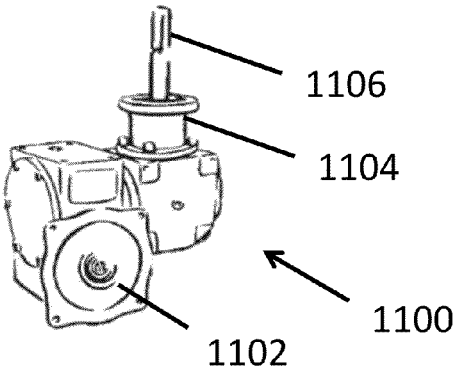
FIG. 11 illustrates a perspective view of a transfer mechanism that may be used with the insulation blowing machine of FIGS. 10A and 10B.
Figure 10B:
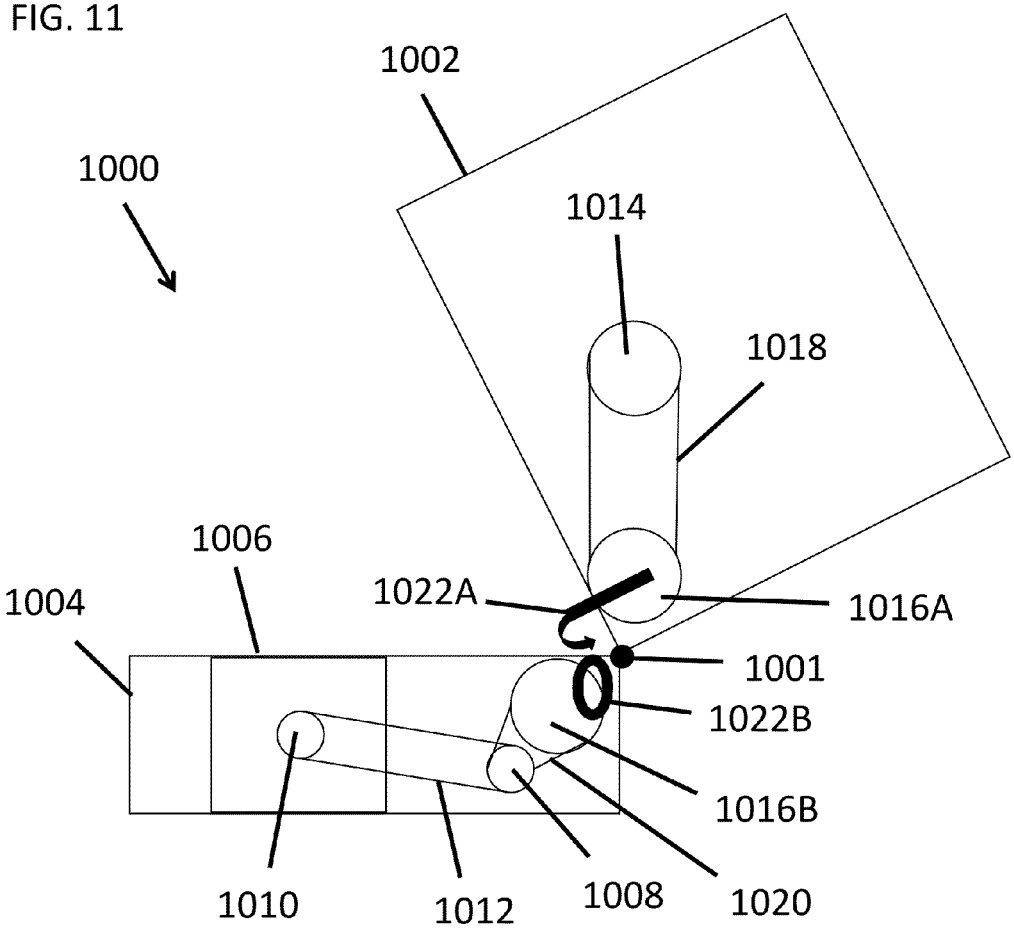

FIGS. 10A and 10B (collectively FIG. 10) schematically illustrate a variation 1000 of the embodiment of an insulation blowing machine illustrated in 900 of FIG. 9. The machine 1000 includes an upper section with a hopper 1002 and a base 1004 connected by a pivoting mechanism 1001 (such as a hinge or set of hinges) allowing the upper section to be tilted from a closed position back from the base 1004 into an open position. The base 1004 includes an airlock 1006 and airlock paddle axle 1010. The hopper 1002 includes an agitator axle 1014 coupled to an agitator. In the embodiment of FIG. 10, a common airlock/agitator motor 1008 is located in the base 1004 and is coupled to the airlock paddle axle 1010 with a belt 1012. The common motor 1008 is coupled to the agitator 1014 through upper and lower transfer axles 1016A, 1016B in the hopper 1002 and base 1004, respectively, and a set of transfer mechanisms 1022A, 1022B which connect when the machine 1000 is in the closed position (FIG. 10A), thereby transferring power from the common motor 1008 to the agitator 1014, and separate when the machine 1000 is in the open position (FIG. 10B). The agitator 1014 is connected to the upper transfer axle 1016A with a belt 1018. The common motor 1008 may be directly connected to the lower transfer axle 1016B or, instead, may be coupled through a belt 1020, which may provide more flexibility with respect to the location of the common motor 1008. It will be appreciated that the common motor 1008 may also be located in the hopper 1002 with appropriate changes to the configuration of other components. The transfer axles 1016A, 1016B are merely representative of mechanisms that may be used to transfer power from the common motor 1008 to the agitator 1014; it will be appreciated that other power transfer mechanisms may be used instead. Use of the transfer axles 1016A, 1016B and transfer mechanisms 1022A, 1022B also facilitates the complete removal of the hopper 1002 from the base 1004 for service, repairs, or other reasons.

The transfer mechanisms 1022A, 1022B may be any appropriate mechanism that transfers the rotary motion of the common motor 1008 and lower axle 1016B to the upper axle

1016A and subsequently to the agitator 1014. For example, a jack screw 1022A, 1022B is illustrated in FIG. 10. The jack screw includes a hook 1022A connected to the upper axle 1016A that engages/disengages a corresponding opening 1022B in the lower axle 1016B. Other means to transfer the rotational motion of the common motor 1008 to the agitator 1014 may also be used, such as a right-angle gearing mechanism 1100 illustrated in FIG. 11. The mechanism 1100 includes a lower section 1102 coupled to the lower axle 1016B and an upper section 1104. The upper section 1104 may include a shaft 1006 that removably engages the with the upper axle 1016A when the hopper 1002 is in the closed position and which disengages from the upper axle 1016A when the hopper 1002 is in the open position or is removed. The shaft may have a geometric cross-section with at least one flat side (such as square, hexagonal, or semi-circular) that mates with an opening of the same geometric cross-section in the upper axle 1016A.

It will be appreciated that any of the axles in the embodiments may include pulleys or sprockets, depending on the type of belts or chains that are used. Further, the physical orientation of the components illustrated in the FIGS. is for clarity in viewing the FIGS. and is representative of just one possible orientation. Any of the components may have other orientations to meet various design requirements. In addition, as noted previously, the term "belt" is used herein generically to refer to any means for transferring the rotational motion of the common motor to other components of the machine.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An insulation blowing machine, comprising:

an upper section, comprising:

a hopper;

an agitator; and an agitator motor coupled to drive the agitator;

a base, comprising:

a blower;

an airlock; and an airlock motor coupled to drive airlock paddles within the airlock; and a pivoting mechanism connecting the upper section with the base, whereby the upper section is tiltable on the pivoting mechanism away from the base to an open position without disassembly or disengagement of components in the upper section from components in the base to expose the airlock paddles within the airlock;

whereby, in operation insulation fed into the hopper passes through an opening in the bottom of the hopper and into the airlock to be discharged through an outlet.

2. The insulation blowing machine of claim 1, further comprising a sliding gate that is closable when the upper section is tilted back from the base.

3. The insulation blowing machine of claim 1, further comprising an interlock configured to disconnect electrical components in the upper section and the base when the upper section is tilted away from the base.

* * * * *